US007745753B2

(12) United States Patent
Schafer et al.

(10) Patent No.: US 7,745,753 B2
(45) Date of Patent: Jun. 29, 2010

(54) CAPACITOR SWITCH INCLUDING A BI-DIRECTIONAL TOGGLE MECHANISM AND LINEARLY OPPOSING OPENING AND CLOSING SPRING LATCHES

(75) Inventors: Bradley J. Schafer, Hampton, GA (US); Neil A. McCord, Fayetteville, GA (US); Joseph R. Rostrom, McDonough, GA (US); Joseph Lyu, Hampton, GA (US); Todd Douthit, Riverdale, GA (US)

(73) Assignee: Southern States, Inc., Hampton, GA (US)

( * ) Notice: Subject to any disclaimer, the term of this patent is extended or adjusted under 35 U.S.C. 154(b) by 449 days.

(21) Appl. No.: 11/944,111

(22) Filed: Nov. 21, 2007

(65) Prior Publication Data

US 2008/0116049 A1 May 22, 2008

Related U.S. Application Data

(60) Provisional application No. 60/860,307, filed on Nov. 21, 2006.

(51) Int. Cl.
*H01H 5/00* (2006.01)

(52) U.S. Cl. ..... 200/400

(58) Field of Classification Search ..... 200/400, 200/401

See application file for complete search history.

(56) References Cited

U.S. PATENT DOCUMENTS 4,049,936 A * 9/1977 Frink et al. ..... 218/12
5,059,753 A * 10/1991 Hamm ..... 218/84
7,078,643 B2 * 7/2006 Rostron et al. ..... 218/144
7,115,828 B2 * 10/2006 McCord et al. ..... 200/400

* cited by examiner

*Primary Examiner*—Michael A Friedhofer
*Assistant Examiner*—Lheiren Mae A Caroc
(74) *Attorney, Agent, or Firm*—Michael J. Mehrman; Mehrman Law Offices, P.C.

(57) ABSTRACT

An electric power switch suitable for use as a capacitor switch that includes a drive unit having a bi-directional toggle mechanism and linearly opposing opening and closing spring latches. The opening and closing spring latches are located on opposing sides of the toggle mechanism, which includes an open-cage spring mechanism with coaxial, nested opening and closing springs operated by a rotating, motor-driven charging cam. To open the circuit interrupter, the opening spring latch is tripped to release the opening spring and thereby remove the capacitor bank from the electric power circuit. To introduce the capacitor bank into the electric power circuit, the motor rotates the charging cam through one complete rotation, which charges the opening and closing springs and trips the closing spring latch to release the closing spring to close the circuit interrupter and thereby introduce the capacitor bank into the electric power circuit.

20 Claims, 13 Drawing Sheets

DRIVE UNIT STATE: INTERRUPTER OPEN, OPEN SPRING CHARGED, CLOSE SPRING CHARGED

DRIVE UNIT STATE: INTERRUPTER OPEN, OPEN SPRING DISCHARGED, CLOSE SPRING DISCHARGED

DRIVE UNIT STATE: INTERRUPTER NOT SHOWN, OPEN SPRING CHARGED, CLOSE SPRING NOT SHOWN

DRIVE UNIT STATE: INTERRUPTER NOT SHOWN, OPEN SPRING DISCHARGED, CLOSE SPRING NOT SHOWN

DRIVE UNIT STATE: INTERRUPTER CLOSED, OPEN SPRING CHARGED, CLOSE SPRING DISCHARGED

EVENT: NORMAL OPERATING MODE, INTERRUPTERS CLOSED, DRIVE UNIT READY FOR OPENING STROKE

DRIVE UNIT STATE: INTERRUPTER OPEN, OPEN SPRING DISCHARGED, CLOSE SPRING DISCHARGED

EVENT: SOLENOID OPERATED, OPENING STROKE TRIGGERED, CIRCUIT INTERRUPTERS OPENED

DRIVE UNIT STATE: INTERRUPTER OPEN, OPEN SPRING CHARGED, CLOSE SPRING CHARGED

EVENT: INTERRUPTER DRIVE UNIT PARTIALLY RESET, CHARGING CAM ROTATED JUST PRIOR TO TRIGGERING CLOSING STROKE

DRIVE UNIT STATE: INTERRUPTER CLOSED, OPEN SPRING CHARGED, CLOSE SPRING DISCHARGED

EVENT: INTERRUPTER DRIVE UNIT RESET, CHARGING CAM FULLY ROTATED , CLOSING STROKE TRIGGERED

CAPACITOR SWITCH INCLUDING A BI-DIRECTIONAL TOGGLE MECHANISM AND LINEARLY OPPOSING OPENING AND CLOSING SPRING LATCHES

REFERENCE TO PRIORITY APPLICATIONS

This application claims priority to commonly-owned U.S. Provisional Patent Application No. 60/860,307, filed Nov. 21, 2006, which is incorporated herein by reference.

REFERENCE TO DISCLOSURES INCORPORATED BY REFERENCE

This application incorporates by reference the disclosures of commonly-owned U.S. Pat. Nos. 7,115,828; 7,078,643; 6,583,978; 6,483,679; 6,316,742 and 6,236,010.

TECHNICAL FIELD

The present invention relates to electric switchgear and, more particularly, relates to an electric power switch, which is suitable for use as a capacitor switch at distribution and sub-transmission voltages, including a bi-directional toggle mechanism and linearly opposing opening and closing spring latches.

BACKGROUND OF THE INVENTION

Switching of capacitor banks is a common occurrence in electric power systems. The inductive reactance of motors in home and industrial use cause less than unity power factors, which if uncorrected can increase system losses and cause voltage levels delivered to end-use customers to drop to unacceptable levels. Capacitor banks are typically switched into the electric power circuits during high levels of inductive loading, typically during the daylight and early evening hours when most people are awake and using electric power, to correct the power factor, reduce delivery losses, and boost the voltage to the end-use customers. Once the high level inductive loading subside, typically at night, the capacitor banks are switched out of the electric power circuit. Daily cyclical use of capacitors is therefore a common practice to balance the capacitive reactance with inductive loads, and thus minimizing the stated problem, as electric loads increase and decrease on a daily basis.

Because inductive residential loads typically increase and decrease on a daily cycle, capacitor switching in response to residential loads typically occurs on a daily basis. Capacitor switching can also occur multiple times daily, for example when residential loads are combined with industrial or municipal loads that occur at night or multiple times per day. Coal mining equipment, aluminum smelters, manufacturing assembly lines, municipal water pumps, and electric transportation loads, to name but a few examples, can place large, cyclical or intermittent inductive loads on an electric power system. As a result, capacitor switches often experience several hundred to several thousand operations per year. Circuit breakers that are designed to operate in response to overload and other emergency conditions, by comparison, typically operate much less frequently, on the order of only a few isolated operations up to a couple of dozen times per year.

Nevertheless, electric utilities have often utilized the same circuit switching technology used in circuit breakers for capacitor switching applications, despite the fact that the circuit breaker technology is not designed to operate nearly as frequently as capacitor switches typically experience. For example, circuit breakers are typically designed for an industry standard of 2,000 to 10,000 operations, which is intended to cover the entire lifetime of the circuit breaker. While this standard is robust and appropriate for a circuit breaker that can be expected to operate only a couple of dozen times per year, it is inadequate for a capacitor switch that can be expected to operate several hundred to several thousand operations per year. Conventional circuit breaker technology can therefore be expected to wear out too quickly when put into operation for capacitor switching applications. Circuit breakers are also designed to switch under very high short-circuit emergency current conditions, which capacitor switches are not expected to experience in normal daily operation. It is therefore inefficient and to utilize circuit breaker technology for capacitor switching applications.

As a result, capacitor switches have been designed to withstand tens of thousands of cycles. Commonly owned U.S. Pat. Nos. 7,115,828; 7,078,643; 6,583,978; 6,483,679; 6,316,742 and 6,236,010 are good examples of electric power switching technology designed specifically for the capacitor switching application. For these capacitor switches, the spring mechanism that accelerates the electrical contactor is a critical component. Because a capacitor switch normally operates to switch the capacitor bank into or out of an energized power circuit on both the opening and the closing stroke, the electrical contactor must be accelerated to an appropriate speed on both the opening and the closing strokes. In addition, because the capacitor switch is designed to cycle on at least a daily basis, the capacitor switch is preferably motorized so that it can be operated from a remote control center or automatically in response to monitored line conditions. When the capacitor switches are well designed and cost effective, an electric utility typically finds it economically feasible to install capacitor banks in many locations throughout the electric power sub-transmissions and distribution system, resulting in a dozens or hundreds of economical capacitor switch installations for a particular electric utility, and thousands of economical capacitor switch installations across the greater power grid. Considerable effort therefore goes into designing capacitor switches that have advantageous size, cost, operating and reliability characteristics.

One prior capacitor switch design in described in U.S. Pat. No. 4,636,602, which discloses a capacitor switch with a bi-directional toggle mechanism and nested opening and closing springs. However, the toggle mechanism in this design relies on expanding and contracting latch rings on a piston inside a cylinder to charge and release the opening and closing springs. Although this design is functional, the latch and trip mechanisms for the expanding and contracting latch rings are complex and can cause undesirable binding in the slide mechanism. The piston and cylinder arrangement is also a relatively large, bulky and heavy design. Placing the trip and latch components within a closed cylinder also makes it difficult to inspect and service these components, requiring disassembly of the drive unit and removal of the piston and cylinder latch mechanism.

Accordingly, there is an ongoing need for a cost effective electric power switch suitable for use as a capacitor switch. There is a further need for a capacitor switch that includes an improved bi-directional toggle mechanism that does not rely on expanding and contracting latch rings located on a piston inside a cylinder to charge and release the opening and closing springs.

SUMMARY OF THE INVENTION

The present invention meets the needs described above in an electric power switch for introducing and removing an electric service component from an electric power system. In particular, the switch is suitable for use as a capacitor switch for introducing and removing a capacitor bank from an electric power circuit. The capacitor switch includes a drive unit having a bi-directional toggle mechanism and linearly opposing opening and closing spring latches. The opening and closing spring latches are located on opposing sides of the toggle mechanism, which includes an open-cage spring mechanism with coaxial, nested opening and closing springs operated by a rotating, motor-driven charging cam. When the capacitor bank is disconnected from the electric power circuit, the drive unit maintains the circuit interrupter in an open configuration with the opening and closing springs discharged. To introduce the capacitor bank into the electric power circuit, the motor rotates the charging cam through one complete rotation, which charges the opening and closing springs and trips the closing spring latch to release the closing spring to close the circuit interrupter and thereby introduce the capacitor bank into the electric power circuit. The drive unit then maintains the circuit interrupter in a closed configuration with the opening spring charged, ready to remove the capacitor bank from the electric power circuit. When it is time to open the circuit interrupter, the opening spring latch is tripped to release the opening spring and thereby remove the capacitor bank from the electric power circuit. This returns the drive unit and circuit interrupter to their original configurations, in which the drive unit maintains the circuit interrupter in the open configuration with the opening and closing springs discharged.

The capacitor switch includes a number of additional advantageous features. In particular, the circuit interrupter includes a removable lid that provides access to a removable insertion resistor. This allows the insertion resistor to be changed out without having to remove or disassemble the circuit interrupter. In addition, the linkage in the drive unit includes dual slot links to prevent binding in the toggle action. The drive unit also includes in-line bumper rings to cushion the deceleration of the open and close plungers to reduce jarring and wear in the drive unit. The open-cage configuration of the spring mechanism allows easy access to these components for inspection and maintenance. The linear layout of the drive unit, with the opening and closing spring latches positioned on opposing sides of the toggle mechanism, is also amenable to easy access to these components for inspection and maintenance.

Generally described, the invention may be as an interrupter drive unit in or for an electric power switch for switching an electric service device, such as a capacitor bank into and out of electric communication with an electric power circuit. In each configuration, the advantages of invention are accomplished by the interrupter drive unit, which is specifically designed to operate an electric power switch for an alternating current electric power system operating at a system frequency, typically about fifty or sixty Hertz depending on the local system operating standard. The electric power switch typically includes a circuit interrupter with an electric contactor for introducing and removing the electric service component from an electric power circuit. The interrupter drive unit is typically connected to the circuit interrupter by way of an interrupter linkage that moves the electric contactor between a closed position in which the electric service component is electrically connected to the electric power circuit and an open position in which the electric service component is electrically removed from the electric power circuit.

The interrupter drive unit includes an opening spring that is operative for moving the interrupter linkage through an opening stroke to move the electric contactor from the closed position to the open position while preventing a current restrike at the system frequency. The opening spring is regulated by an opening spring latch that is movable to a latched position for maintaining the opening spring in a charged configuration, and movable to a tripped position in response to an open trip action to release the opening spring to move the interrupter linkage through the opening stroke. An opening stroke triggering device imparts the open trip action to the opening spring latch The interrupter drive unit includes a closing spring that is operative for moving the interrupter linkage through a closing stroke to move the electric contactor from the open position to the closed position while conducting a current arc during less than one-half of a current cycle at the system frequency. The opening spring is regulated by a closing spring latch that is movable to a latched position for maintaining the closing spring in a charged configuration and releasing the closing spring in response to a close trip action to move the interrupter linkage through the closing stroke. A closing stroke triggering device imparts the close trip action to the closing spring latch;

In addition, the interrupter drive unit includes a bi-directional toggle mechanism that is operative for moving the opening spring latch to its latched position, moving the opening spring to its charged configuration, moving the closing spring latch to its latched position, and moving the closing spring to its charged configuration. The opening spring latch, the closing spring latch and the toggle mechanism are positioned in a linear configuration with the toggle mechanism located linearly between the opening spring latch and the closing spring latch.

The interrupter drive unit may also include a charging cam operative to rotate through an operational cycle. During the operational cycle, the cam sets the opening spring latch to maintain the opening spring to its charged position, moves the opening spring to its charged position, sets the closing spring latch to maintain the closing spring to its charged position, moves the closing spring to its charged position, and trips the closing spring latch. In this configuration, the interrupter drive unit may also include an electric motor operative for rotating the charging cam through its operational cycle.

In its normal operating mode, when the electric service device is connected to the electric circuit, the interrupter drive unit may be configured to maintain the circuit interrupter in the closed configuration with the opening spring charged, ready to remove the electric service component from the electric power circuit, while the electric service component is electrically connected to the electric power circuit. In addition, when the electric service device is removed from the electric circuit, the interrupter drive unit may be configured to maintain the circuit interrupter in the open position with the opening and closing springs discharged when the electric service component is electrically disconnected from the electric power circuit.

With respect to more detailed design features, the opening stroke triggering device may be an electric solenoid, and the closing stroke triggering device may be a mechanical trigger actuated by the bi-directional toggle mechanism. The opening spring and the closed spring may also be arranged in a coaxial nested arrangement, and the toggle mechanism may include first and second slot links to prevent binding in the toggle action.

In view of the foregoing, it will be appreciated that the present invention provides a cost effective electric power switch suitable for use as a capacitor switch. In particular, the configuration of the device when deployed as a capacitor switch gives it a number of advantages over conventional capacitor switches, including the provision of a switch that is less expensive, less complex, and more reliable than conventional designs.

DETAILED DESCRIPTION OF THE EMBODIMENTS

The present invention may be embodied in a drive unit in or for an electric power switch, such as a capacitor switch, for connecting and disconnecting an electric service component to an electric power circuit. The specific electric power switch described below with minor modifications to adapt to the specific operating voltage is suitable for use as a capacitor switch at distribution and sub-transmission voltages up to about 72.5 kV. With appropriate modifications to provide adequate lengths and acceleration for the opening and closing strokes, the same basic switch design can be use to implement switches for transmission voltages up to about 245 kV. The drive unit is designed to operate three suitable circuit interrupters to create a three-phase electric power switch. An illustrative circuit interrupter is described in commonly-owned U.S. Pat. No. 7,078,643, and the present invention may be implemented as an improvement to this device as a retrofit or as part of new system equipment. The invention may also be deployed in connection with one or more of the electric power switch features disclosed in commonly-owned U.S. Pat. Nos. 7,115,828, 6,583,978; 6,483,679; 6,316,742 and 6,236,010. All of these patents are incorporated herein by reference.

The improved interrupter drive unit, with a linearly arranged drive train including open and close latches on either side of a bi-directional toggle mechanism, allows for this device to achieve a nominal designed rating of at least twenty thousand (20,000) operations, which represents a significant improvement over prior capacitor switching mechanisms. The drive unit is also less expensive, more reliable, more compact, and easier to maintain that prior capacitor switching mechanisms. These improvement results primarily from the linear arrangement of the drive train, which provides for an improved latch design and an open cage spring mechanism. Other features and advantages of the invention and its illustrative embodiments are described below with reference to the figures.

Figure 1:
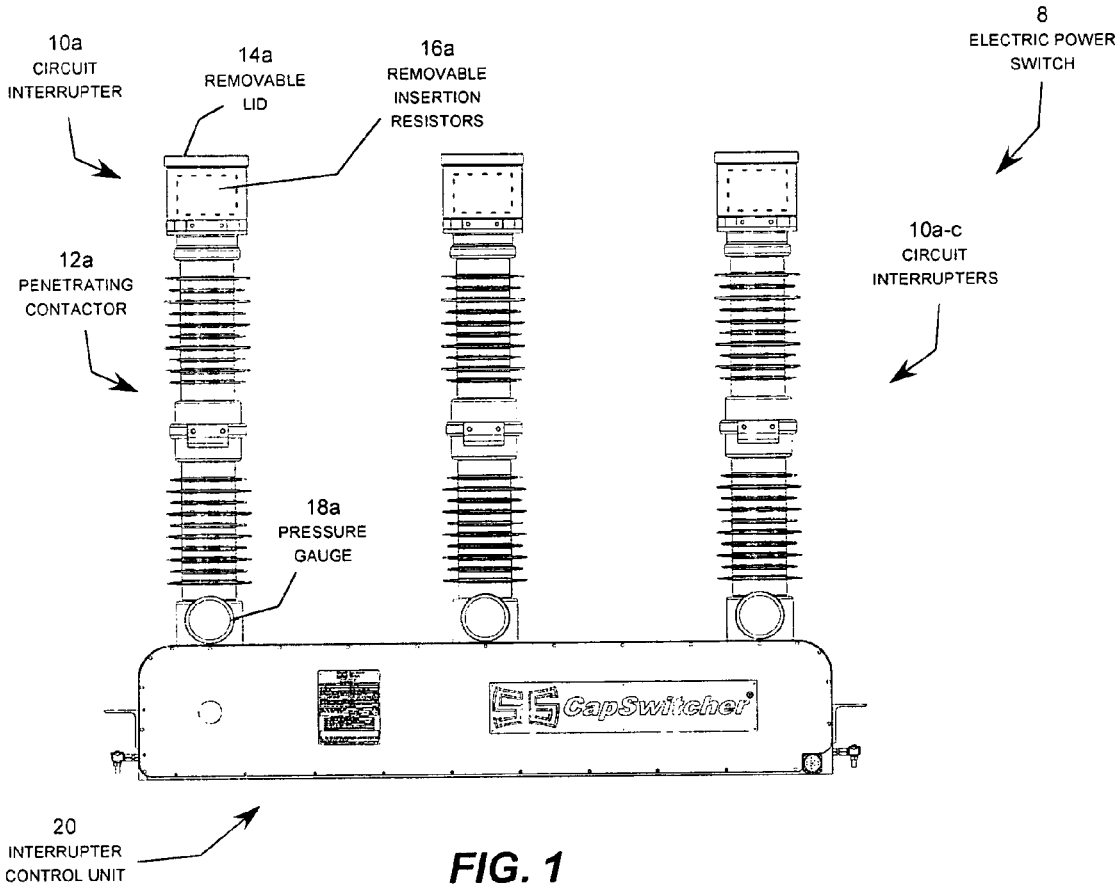
FIG. 1 is a front view of a three phase electric power switch including an interrupter control unit.

Turning now to the figures, in which like numerals refer to similar elements throughout the several figures, FIG. 1 is a front view of an illustrative three phase electric power switch 8 that including three circuit interrupters 10*a-c* and an interrupter control unit 20. Referring to an illustrative circuit interrupter 10*a*, this device includes a penetrating contactor 12*a* located within a hollow insulator and a removable lid 14*a* that provides access to a removable insertion resistor 16*a* in an end cap of the interrupter. The basic structure and operation of the penetrating contactor is described in U.S. Pat. Nos. 6,583,978; 6,483,679; 6,316,742 and 6,236,010. The insertion resistor and penetrating contactor are described in greater detail in U.S. Pat. No. 7,078,643 and a prior design for a toggle mechanism is described in U.S. Pat. No. 7,115,828. In summary, the penetrating contactor is located inside the hollow insulator, which is filled with a dielectric gas, typically sulphur hexafluoride ($SF_6$), which helps extinguish electric arcs that occur in the spark gap of the penetrating contactor. This particular circuit interrupter includes a pressure gauge 18*a* that shows the pressure of the dielectric gas inside the insulator. The control unit 20 accelerates the penetrating contactor and temporarily inserts the insertion resistor into the power circuit on the opening and closing strokes of the internal contactor.

More specifically, the control unit 20 accelerates the penetrating contactor, which includes two contactors that move into and out of electrical communication and physical contact during the opening and closing strokes, while forcing the dielectric gas to flow into the gap between the contactors to extinguish the spark that forms in the gap between the contactors as the contactors move into and out of electric connection under high voltage. A capacitor bank for an electric power circuit stores a large electric charge, which discharges (at least in part) across the spark gap between the contactors during the opening stroke. The contactor also conducts an arc on the closing stroke as the contactors physically approach each other. The drive unit for a capacitor switch should therefore be designed to accelerate the contactor sufficiently to extinguish the arcs that occur in the spark gap of the contactor on the opening and closing strokes. For a capacitor switch, the opening stroke is usually more critical than the closing stroke because there is typically less time and travel distance for the contactors to accelerate from the closed position during the opening stroke.

In addition, because the voltage is alternating, the current inherently extinguishes periodically at each current zero crossing and the voltage periodically builds to its peak magnitude each half cycle, the voltage tends to cause a restrike as the voltage approaches its maximum magnitude each half cycle. Each time the current restrikes as the spark gap widens on the opening stroke the restrike occurs as a higher voltage. A restrike occurring across a relatively high voltage across a relatively wide contactor gap, for example a first or second restrike during an opening stroke can damage the contactor and cause an undesirable disturbance on the electric power circuit. For this reason, the basic design criterion of the drive unit 30 is to accelerate the contactors of the circuit interrupter 10 sufficiently to prevent a restrike from occurring during the opening stroke. On the closing stroke, the contactor is designed conduct an arc for at most one-half of the power cycle, which is 50 Hertz or 60 Hertz depending on the location. The drive unit 30 for the 38 kV switch shown in FIG. 1 with minor modification to adapt to the selected operating voltage is suitable for operating circuit interrupters meeting these basic design criteria for electric power switches operating at typical distribution and sub-transmission voltages of 15.5 kV, 25.8 kV, 38 kV, 48.3 kV and 72.5 kV. With appropriate modifications to provide adequate lengths and acceleration for the opening and closing strokes, the same basic switch design can be use to implement switches for transmission voltages up to about 245 kV. The specific electric power switch 8 shown substantially to scale in FIG. 1 is configured to operate at 38 kV.

Figure 2:
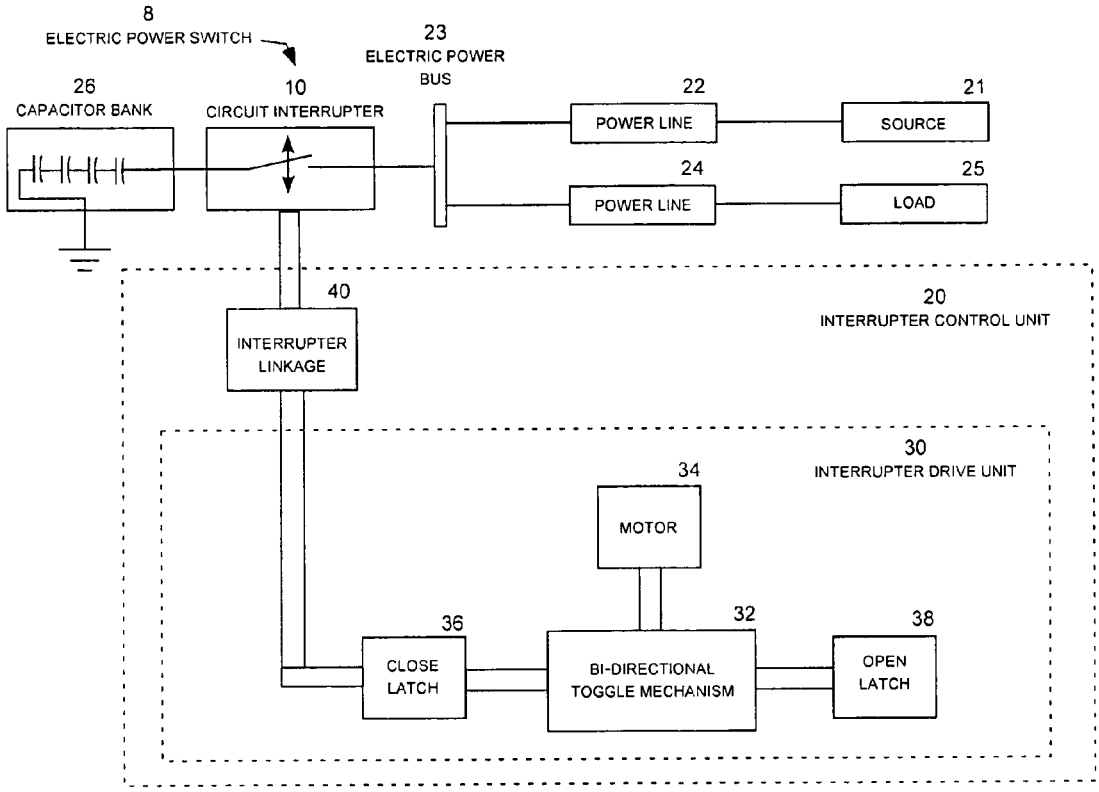
FIG. 2 is a functional block diagram of the electric power switch with the interrupter control unit operated as a capacitor switch.

FIG. 2 is a functional block diagram of the electric power switch 8 operated as a capacitor switch. Although the electric power switch is typically a three-phase device, only one phase is shown in FIG. 2 for descriptive convenience. The electric power switch 8 includes a penetrating circuit interrupter 10 driven by an interrupter control unit 20, as introduced with reference to FIG. 1. The interrupter control unit 20 includes an interrupter drive unit 30 and a mechanical interrupter linkage 40 that transmits motion of the drive unit to the internal contactor of the circuit interrupter 10. For the configuration shown in FIG. 1, the interrupter drive unit 30 generates accelerated lateral movement (horizontal with the switch oriented as shown in FIG. 1) of a connector at the end of a main shaft, which the interrupter linkage 40 translates into lateral motion (vertical with the switch oriented as shown in FIG. 1) of the contactor inside the circuit interrupter 10. For this configuration, the interrupter linkage 40 may be a relatively simple mechanical rocker arm assembly. Of course, gear boxes or other more complex linkages may be employed. Nevertheless, the ability to utilize a relatively simple mechanical rocker arm assembly produces advantages in cost, weight and reliability.

The circuit interrupter 10 is designed to be operated as part of an electric power system forming a large number of electric power circuits, which are represented schematically in FIG. 2 by an electric power source 21 feeding a generation-side electric power line 22, which feeds an electric power bus 23, which is typically located in a substation. The electric power bus 23, in turn, feeds a load-side power line 24 that provides electric power service to a number of loads represented by the load 25. The circuit interrupter 10 switches an electric service component, in this example a capacitor bank 26, into and out of electrical communication with the electric power bus 23. Although the capacitor bank is shown in FIG. 2 in a configuration in which it can be selectively connected in parallel with the electric power circuit (i.e., between ground and the electric power bus), it could alternatively be connected in series with the power line or in any other circuit configuration suitable for a particular application. It should be appreciated that the electric power switch as shown in FIGS. 1 and 2 is specifically designed for operation in and electric power substation. Nevertheless, the electric power switch could be located near a generator, load or other electric service component, which may be operated by the electric utility or another party. For example, the switch could be located on customer premises, for example in association with an on-site generator or load center, or in any other location where high-voltage electric power switching is required. In addition, the electric power switch is specifically designed to switch a capacitor bank but can also be use to switch any type of electric service component, such as a voltage regulator, generation station, sectionalizing switch, load center, and so forth.

As noted above, the interrupter control unit 20 includes an interrupter drive unit 30 and a mechanical interrupter linkage 40 that transmits motion of the drive unit to the circuit interrupter 10. The drive unit 30 includes a linear arrangement with a bi-directional toggle mechanism located between a close latch 36 (also referred to as the closing latch) and an open latch 38 (also referred to as the closing latch). The toggle mechanism is typically operated by a motor 34, which can be controlled locally, remotely or automatically. The linear configuration of the drive unit, with the latches spaced apart from the toggle mechanism, produces significant advantages for the drive unit. These advantages generally include a simpler, less expensive and more reliable electric power switch that is designed to achieve a higher number of switching operations than prior switch configurations designed for the similar applications. The specific toggle and latch mechanisms, and an illustrative operating sequence, are described in greater detail with reference to FIGS. 3-11.

Figure 3:
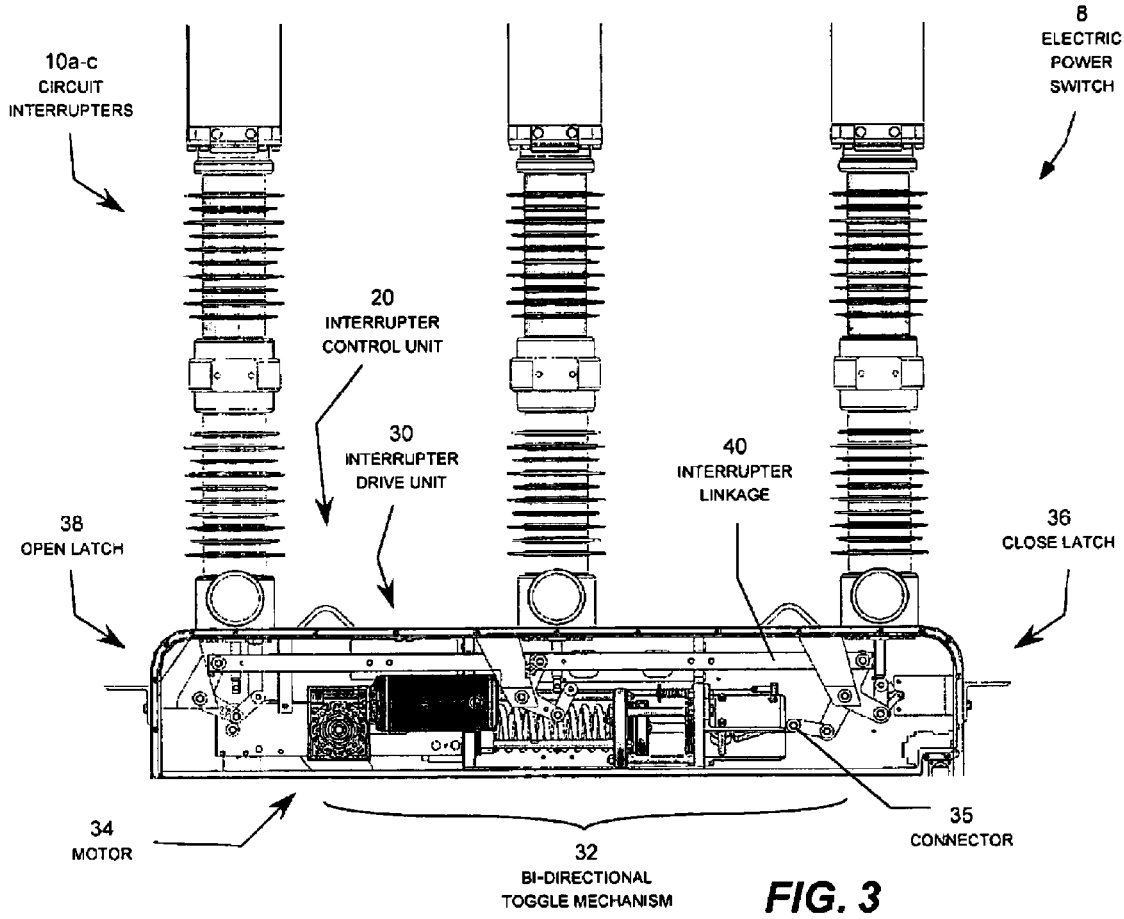
FIG. 3 is a rear view of the electric power switch showing the internal components of the interrupter control unit including an interrupter drive unit and an interrupter linkage.

FIG. 3 is a rear view of the electric power switch 8 showing the internal components of the interrupter control unit 20, which includes the interrupter drive unit 30 and the mechanical interrupter linkage 40. The interrupter drive unit 30 includes the bi-directional toggle mechanism 32 located between the close latch 36 (located to the right of the toggle mechanism in the rear view of FIG. 3) and the open latch 38 (located to the left of the toggle mechanism in the rear view of FIG. 3). The motor 34 drives the bi-directional toggle mechanism as described in detail with reference to the following figures. A connector 35 on the end of a main shaft driven by the interrupter drive unit 30 connects the drive unit to the interrupter linkage 40. The connector 35 moves laterally (horizontally left and right as shown in FIG. 3), and the interrupter linkage 40 translates that motion to lateral movement of the circuit interrupter 10 (vertically up and down as shown in FIG. 3).

Figure 4:
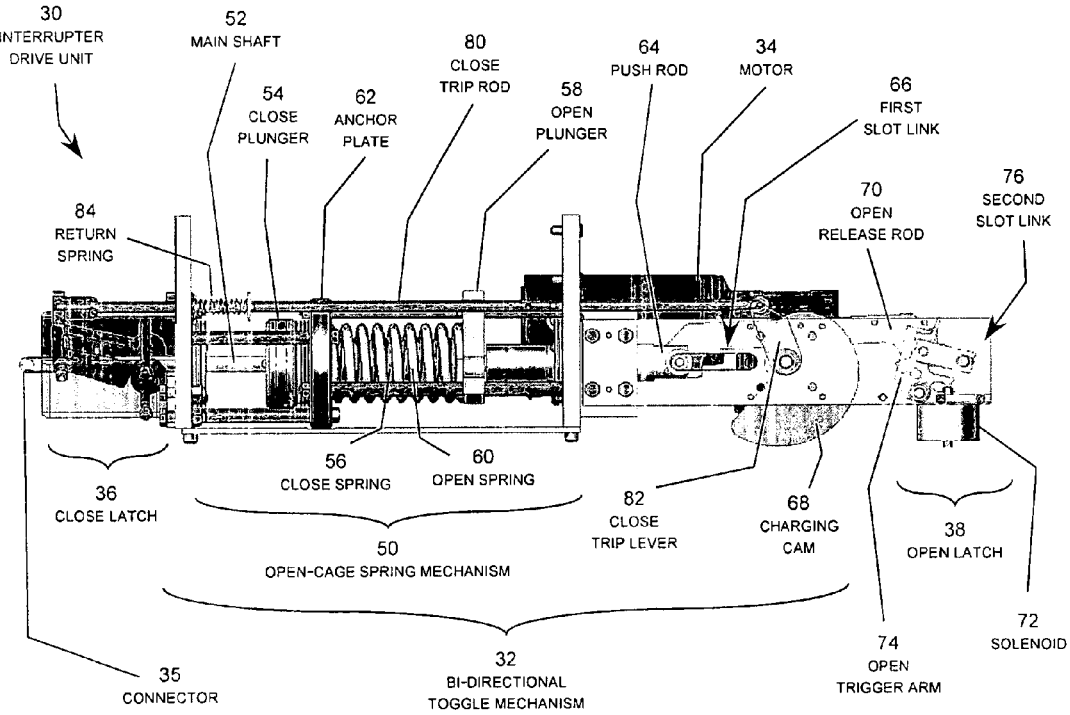
FIG. 4 is a front view of the interrupter drive unit of the electric power switch.

FIG. 4 is a front view of the interrupter drive unit 30. For descriptive convenience, the configuration and orientation of the drive unit as shown in FIG. 4 will be used to describe the movement of the various parts, such as directions including left, right and counterclockwise. It will be understood, of course, that the drive unit could be mounted in other orientations or flipped horizontally. In the illustrative orientation shown in FIG. 4, the close latch 36 is located to the left of the bi-directional toggle mechanism 32 and the open latch 38 is located to the right of the toggle mechanism. The bi-directional toggle mechanism 32 includes an open cage spring mechanism 50 that drives a main shaft 52 left and right through reciprocating lateral movement. The closing spring 56 and the opening spring 60, which are positioned in a nested, coaxial arrangement, are distinguished more clearly in FIG. 8, where they are not fully overlapping.

Figure 8:
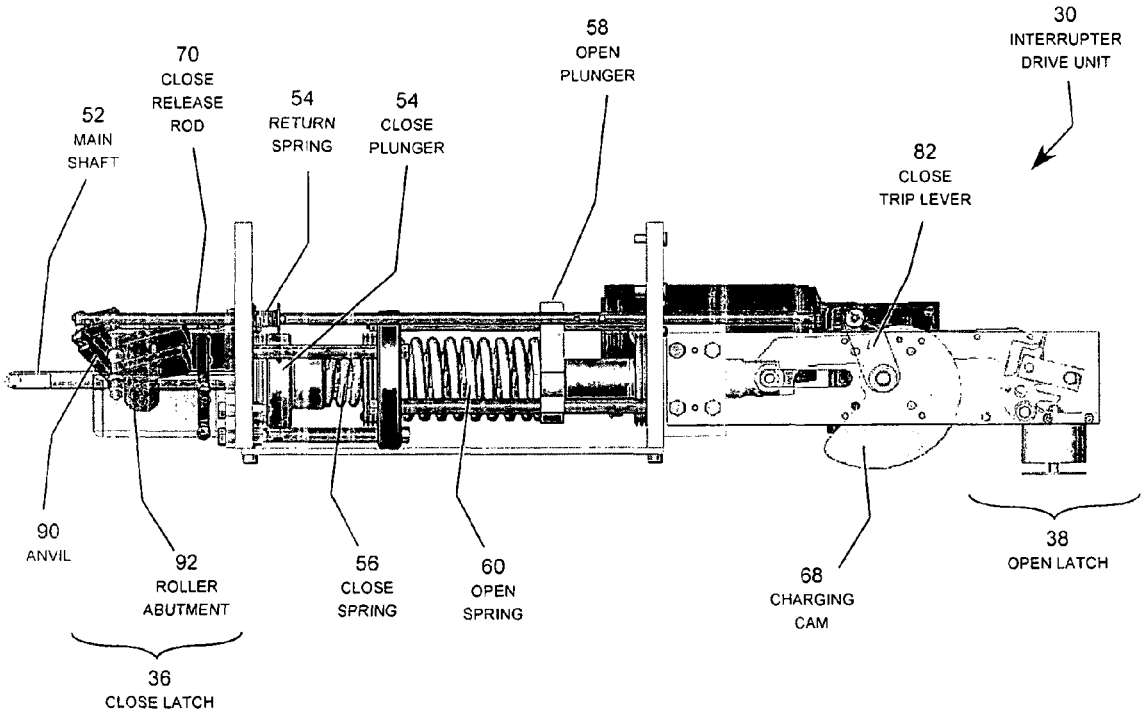
FIG. 8 is a front view of the interrupter drive unit with the circuit interrupter closed, the open spring charged and the close spring discharged.

The drive unit 30 is shown in FIG. 4 with the main shaft 54 in the retracted position (to the right of its range of travel as shown in FIG. 4), the close spring 56 charged (compressed and ready to drive the main shaft 52 to the left into to the extended position). The open spring 50 is also charged and ready to move the main shaft 52 back to the left to the retracted position, to open the switch once again after it has been closed. The main shaft 52 is driven to the left or extended position to close the circuit interrupter, and driven to the right or retracted position to open the circuit interrupter. The main shaft 52 is driven to the left as shown in FIG. 4 by a close plunger 54 under force delivered by a close spring 56 (also called the closing spring) and to the right by an open plunger 58 under force delivered by an open spring 60 (also called the closing spring). That is, the main shaft 52 being positioned to the right in the retracted position as shown in FIG. 4 corresponds to the circuit interrupter 10 being in an open position. When the close plunger 54 drives main shaft 54 to the left to its extended position as shown in FIG. 8, the circuit interrupter 10 is correspondingly driven to its closed position. Conversely, when the open plunger 58 drives the main shaft 52 back to the right to the retracted position, as shown in FIG. 4, the circuit interrupter 10 is correspondingly driven to its open position.

As shown in FIG. 4, the main shaft 52 is in the retracted position, which corresponds to the circuit interrupter 10 being in the open position, with both the closing spring 56 and the opening spring 60 charged. From this configuration, the close latch 36 can be tripped to close the circuit interrupter, which transitions the drive unit 30 from the state shown in FIG. 4 to the state shown in FIG. 8. The open latch 38 can then be tripped to open the circuit interrupter, which transitions the drive unit 30 from the state shown in FIG. 8 to the state shown in FIG. 9. The motor 34 is then activated to rotate the charging cam 68 to charge both springs and thereby reset the drive unit. Rotation of the charging cam 68 can be stopped prior to tripping the close latch 36 to maintain the circuit interrupter in the open position, which leaves the drive unit in the state shown in FIG. 4. The charging cam 68 can also be rotated sufficiently to trip the close latch 36 to maintain the circuit interrupter in the closed position with the open spring 60 charged, which leaves the drive unit to the state shown in FIG. 8.

Figure 9:
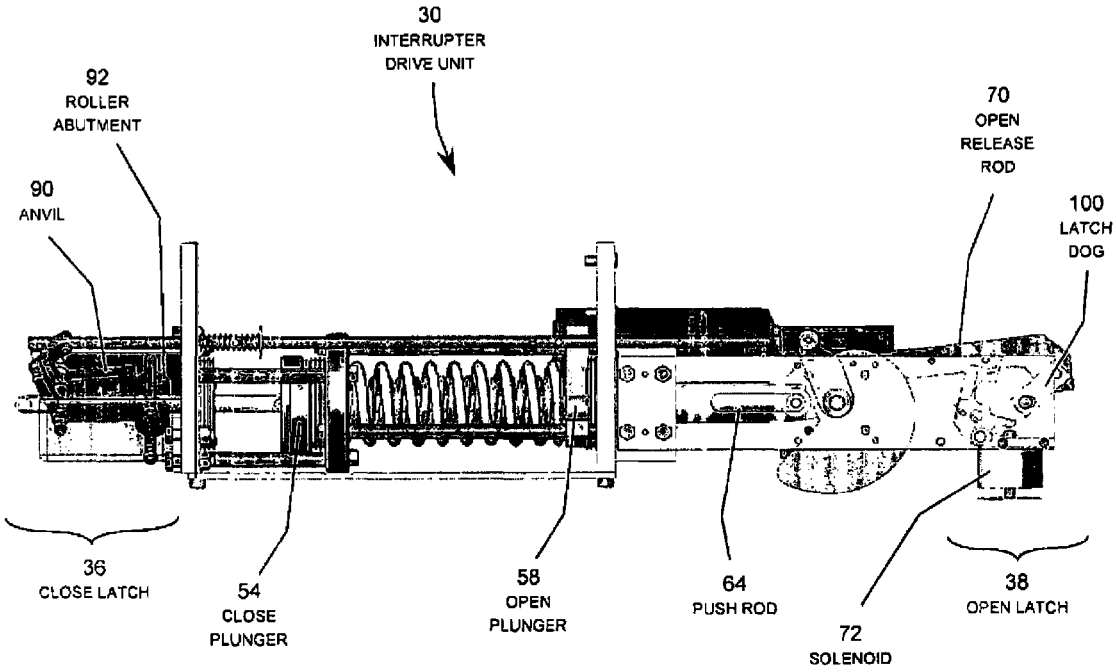
FIG. 9 is a front view of the interrupter drive unit with the circuit interrupter open, the open spring discharged and the close spring discharged.

Referring to the drive unit in the state shown in FIG. 4, the open spring 58 is compressed between the open plunger 58 and an anchor plate 62 by a push rod 64 that moves the open plunger 58 to its left lateral position. The push rod 64 is guided by guide pin that slides within a first slot link 66, which provides a guide for the push rod when moving between its left and right lateral positions. The push rod 64 is shown in FIG. 4 at the left side of the slot link 66, which corresponds to the open plunger 58 being to its left lateral position and the open spring 60 charged. The motor 34 rotates a charging cam 68 to move the push rod 64 from its right lateral position to its left lateral position to charge the open spring 60. When the main shaft 52 is in the extended position and the circuit interrupter is therefore in the closed position (this state is shown in FIG. 8), the open latch 38 can be tripped to release the opening spring 60 to drive the open plunger 58 back to its right lateral position (this state is shown in FIG. 9).

The push rod 64 is also connected to an open release rod 70, which mechanically couples the push rod to the open latch 38. Moving the push rod 64 to its left lateral position causes the open latch 38 to move to a latched position, as shown in FIG. 4, to restrain the open plunger 58 in its left lateral position with the open spring 60 charged. Tripping the open latch 38 releases the open plunger 58 to move to the right under the force provided by the open spring 60. The open latch 38 is tripped by a solenoid 72 that rotates an open trigger arm 74 to trip the open latch, as shown in the transition from FIG. 6 to FIG. 7.

Referring again to FIG. 4, the close spring 56 is also charged by rotating the charging cam 68 when the close latch 36 is in the latched position and the close plunger 54 is to the right of its range of travel. This compresses the close spring 56 between the close plunger 54 and the open plunger 58. The close latch 36 is tripped by a close trip rod 80, which is activated when it is pushed to the left by a close trip lever 82 carried by the charging cam 68. A return spring 84 returns the close trip rod 80 back to the right to its original position when the close trip lever 82 moves past the end of the close trip rod and the close plunger 54 has been moved to the right of its range of travel. The close spring 56 is attached to the close plunger 54 and open plunger 58, which pulls the close plunger 54 from its left position to its right position as the open spring 60 drives the open plunger 58 to the right to open the circuit interrupter. Once the close plunger 54 has been moved to its right lateral position, the close latch 36 resets to the latched position under the spring force provided by the return spring 84. The close spring 56 can then compressed when the charging cam 68 moves the open plunger 58 from its right position to its left lateral position while close latch 36 hold the close plunger 54 in its right lateral position.

Figure 5:
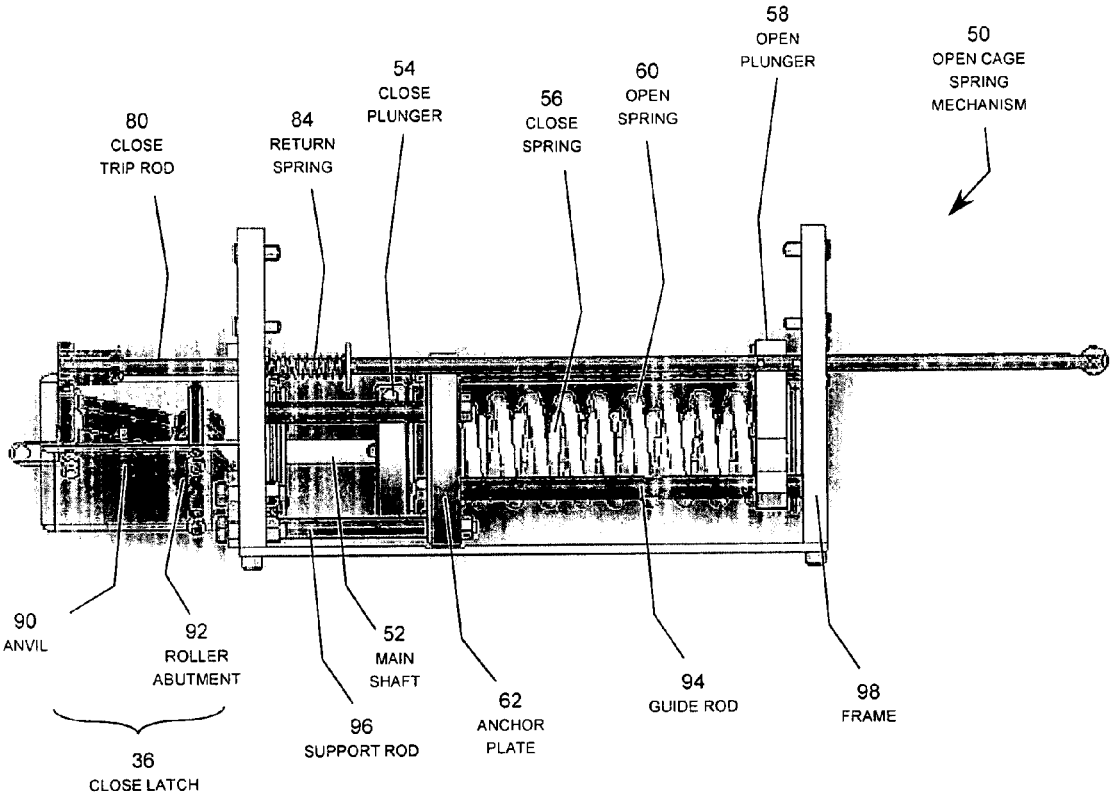
FIG. 5 is a front view of the open cage spring arrangement and close latch mechanism of the interrupter drive unit.

FIG. 5 is a front view of the open cage spring arrangement 50 and the close latch 36 of the interrupter control unit. FIG. 8 is a front view of the interrupter drive unit 30 with the close latch 38 in an open state, and FIG. 9 shows the drive unit with the close latch 36 in its closed or latched state. The close latch 36 includes a pivotally mounted anvil 90 that selectively blocks movement of a roller abutment 92, which is attached to the main shaft 52. The close trip rod 80 is connected to the pivotally mounted anvil 90, which allows movement of the close trip rod to the left to pivot the anvil 90 to move the anvil out of the path of the roller abutment 92. Moving the anvil 90 out of the path of the roller abutment 92 releases the close plunger 54 and the main shaft 52 to move to the left under force applied by the close spring 56, which closes the circuit interrupter. As shown in FIG. 8, the close trip lever 82 is positioned to push the close trip rod 80 to the left when the charging cam 68 has been rotated sufficiently. When the close plunger 54 is moved to its right lateral position and the close trip lever has moved past the end of the close trip rod 80, the return spring 84 pushes the close trip rod 80 back to the right, which drops the anvil 90 into the path of the roller abutment 92 to reset the close latch 36, as shown in FIG. 9. The open plunger 58 slides along a set of four guide rods, which are represented by the enumerated guide rod 94, that pass through holes in the open plunger. A set of four support rods represented by the enumerated guide rod 94 and associated bolts rigidly couple the anchor plate 62 the frame 98, which is mounted to a suitable support structure. The anchor plate 62 and frame 98 do not move as part of the toggle mechanism, whereas the close plunger 54 and the open plunger 58 move laterally as part of the toggle mechanism.

Figure 6:
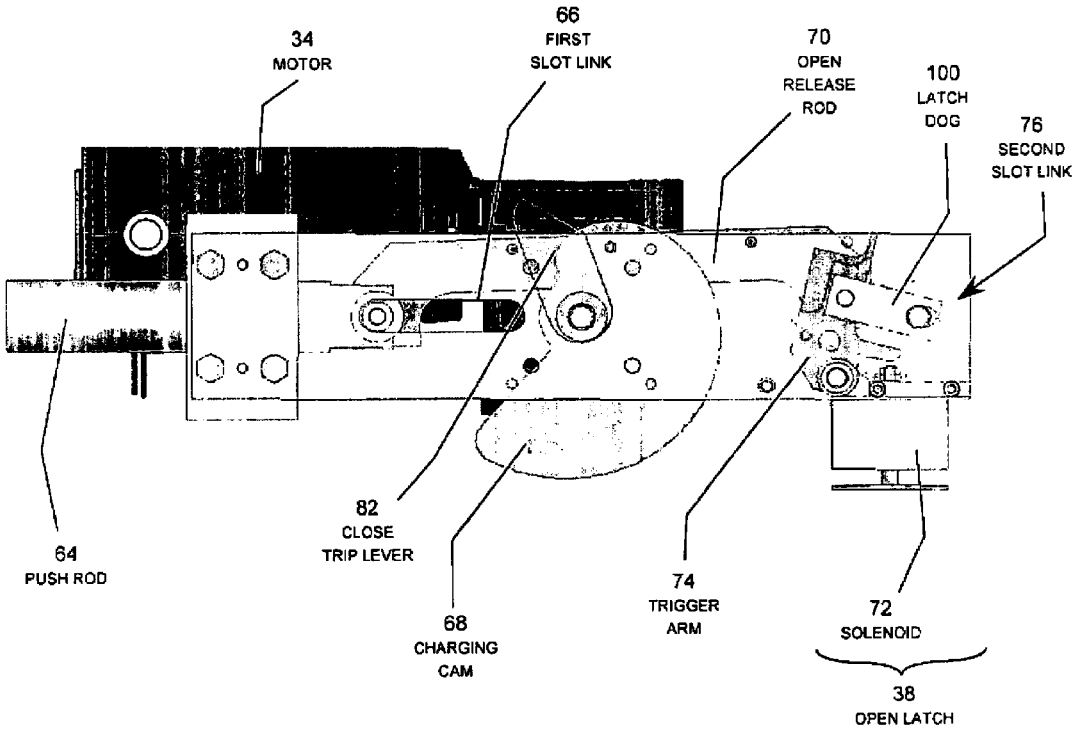
FIG. 6 is a front view of the motor, cam drive and open latch mechanism of the interrupter drive unit with the open spring charged and the open latch in the closed position.
Figure 7:
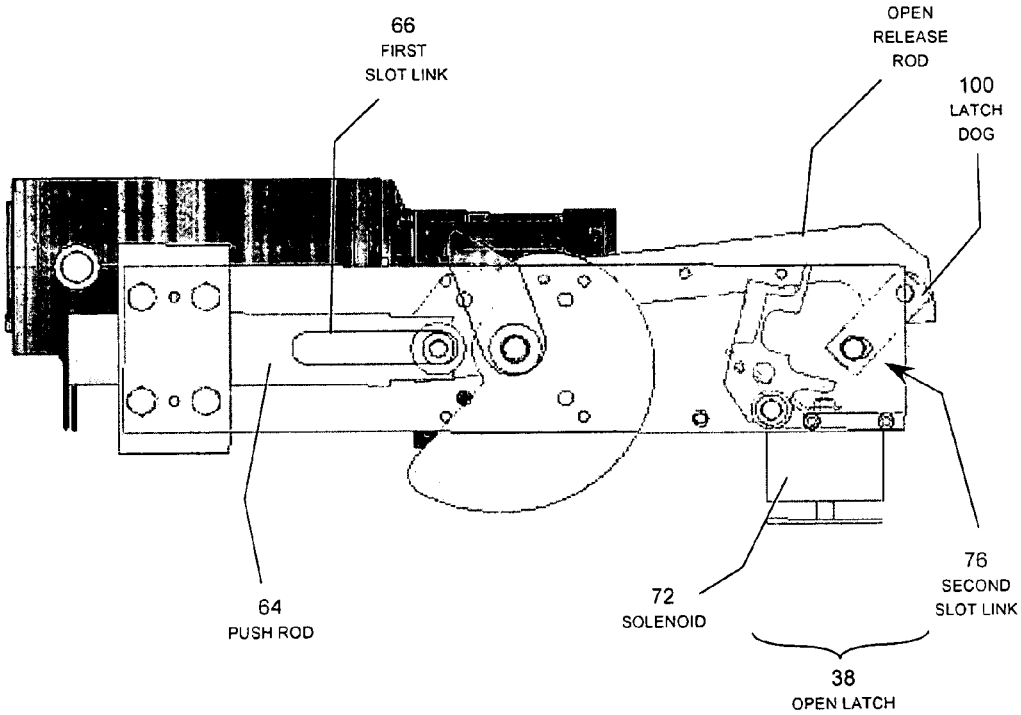
FIG. 7 is a front view of the motor, cam drive and open latch mechanism of the interrupter drive unit with the open spring discharged and the open latch in the open position.

FIG. 6 is a front view of the motor 34, the charging cam 68 and the open latch 38 in the latched state. FIG. 7 shows this assembly with the open latch in its open state. The motor 34 rotates the charging cam 68 counterclockwise to move the push rod from the right side of the first slot link 66 to the left side of the first slot link to move the open plunger to the left and thereby charge the open and close springs. The open latch 38 includes a trigger arm 74 that is selectively latched by a latch dog 100 on the end of the open release rod 70 when the open release rod is moved to its left lateral position. To trip the open latch, the solenoid 72 is electrically activated to extend a push rod upward, which rotate the trigger arm 74 counter-clockwise to release the latch dog 100, which allows the open release rod 70 and the push rod 64 to move to the right under the force provided by the open spring 60. This opens the circuit interrupter and places the open latch 38 in the released state shown in FIG. 7. The open latch 38 returns the to its latched state shown in FIG. 6 when the charging cam 68 is rotated to return the push rod 64 back to its left lateral position.

A typical operating sequence of the drive unit 30 will now be described with FIGS. 8 through 11, which show the interrupter drive unit 30 in a sequence of states. FIG. 8 shows the interrupter drive unit with the main shaft 52 extended to the left, which corresponds to the circuit interrupter being closed. The close latch 36 is in its released position and the close plunger 54 is at its left lateral position. The close spring 56 is therefore discharged. The open latch 38 is in its latched position and the open plunger 58 is at its left lateral position. The open spring 60 is therefore charged. Accordingly, FIG. 8 shows the drive unit 30 in a normal operating mode in which the circuit interrupter is closed and the open spring 60 charged, ready to open the circuit interrupter upon activation of the solenoid 72 to trip the open latch 38.

Activating the solenoid 72 to trip the open latch 38 transitions the drive unit from the state shown in FIG. 8 to the state shown in FIG. 9. The main shaft 52 has moved to the retracted position, which corresponds to the circuit interrupter being in the open position. The open latch 38 is now in its released position, the open plunger 58 and the open release rod 70 are in their right lateral positions, where then have been moved under forced provided by the open spring 60. The open plunger 58 has also been pulled by the close plunger 54 to its right lateral position, which allowed the close latch 36 to reset under the force provided by the return spring 84. In the state shown in FIG. 9, both the open and close springs are discharged and the circuit interrupter is open. The drive unit 30 therefore needs to be reset.

From the state shown in FIG. 9, the drive unit 30 is reset by activating the motor 34 to rotate the charging cam 68. This places the drive unit in the state shown in FIG. 10, which is the same state shown in FIG. 4. The charging cam 68 has moved the open plunger 58 to its left lateral position, with the close latch 36 in the latched position, which charges both the open and close springs. The movement of the open release rod 70 to its left lateral position latches the open latch 38. Accordingly, FIG. 10 shows the drive unit 30 in a reset state in which the circuit interrupter is open with the closing spring 56 and the opening spring 60 charged.

Figure 10:
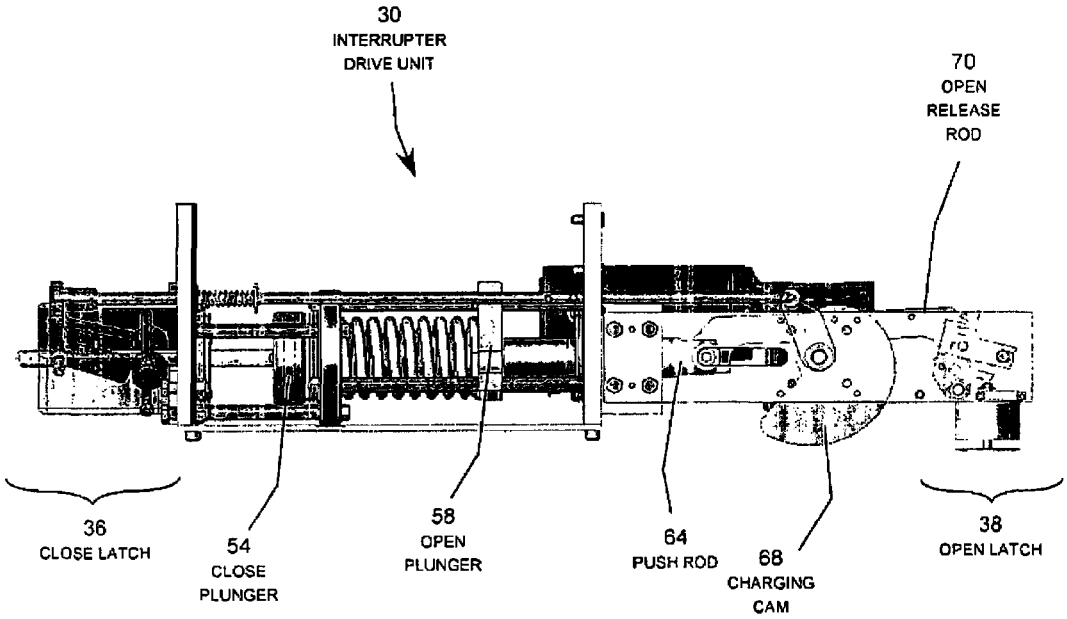
FIG. 10 is a front view of the interrupter drive unit with the circuit interrupter open, the open spring charged and the close spring charged.
Figure 11:
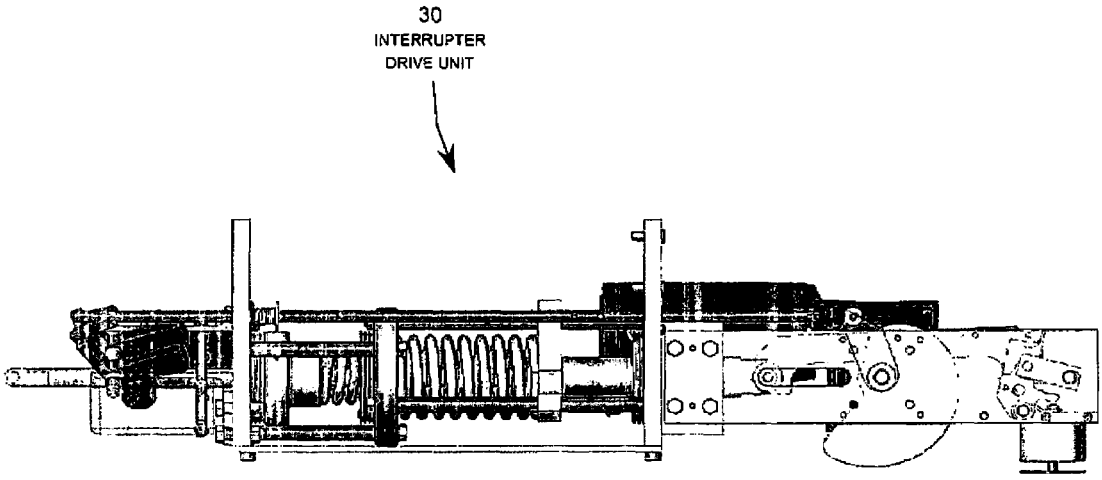
FIG. 11 is a front view of the interrupter drive unit with the circuit interrupter closed, the open spring charged and the close spring discharged.

From the state shown in FIG. 10, the drive unit 30 is ready to close the circuit interrupter upon further rotation of the charging cam 68 sufficient to move the close trip rod 80 to its left lateral position to trip the close latch 36. Tripping the close latch 36 causes the drive unit to transition from the state shown in FIG. 10 to the state shown in FIG. 11. In the state shown in FIG. 11, the close latch 36 has been tripped and the close plunger 54 and the main shaft 52 have moved to their left lateral positions. In this state, the open latch 38 is in the latched position and the open plunger 58 remains at its left lateral position, and the open spring 60 is therefore charged. As full operational cycle has been described, is should b noted that FIG. 11 shows the drive unit 30 in the same state as FIG. 8.

Figure 12:
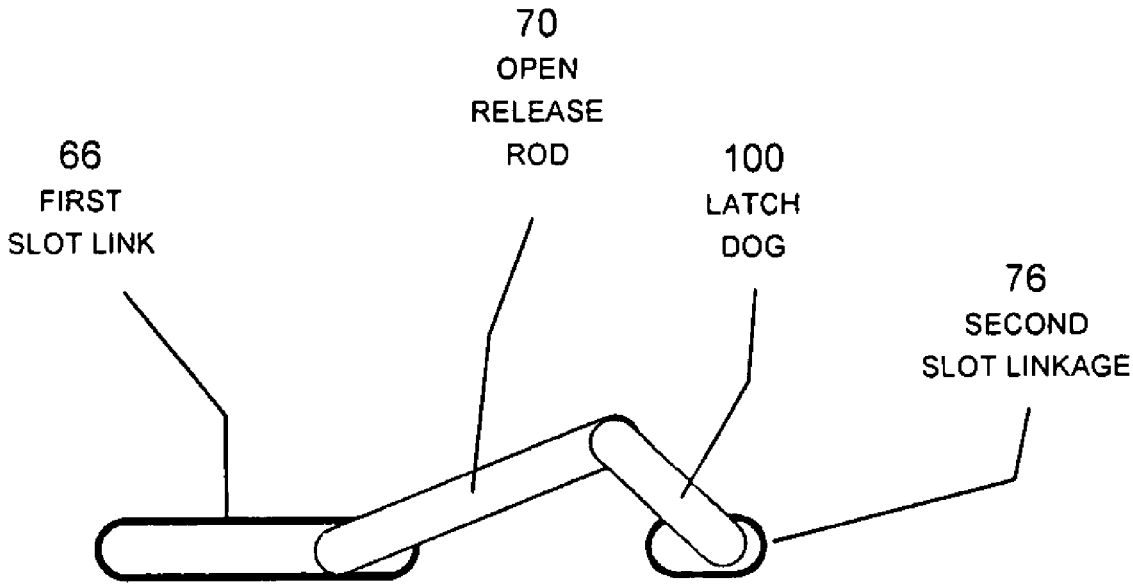
FIG. 12 is a schematic view of a dual slot linkage feature of the bi-directional toggle mechanism of the interrupter drive unit.
Figure 13:
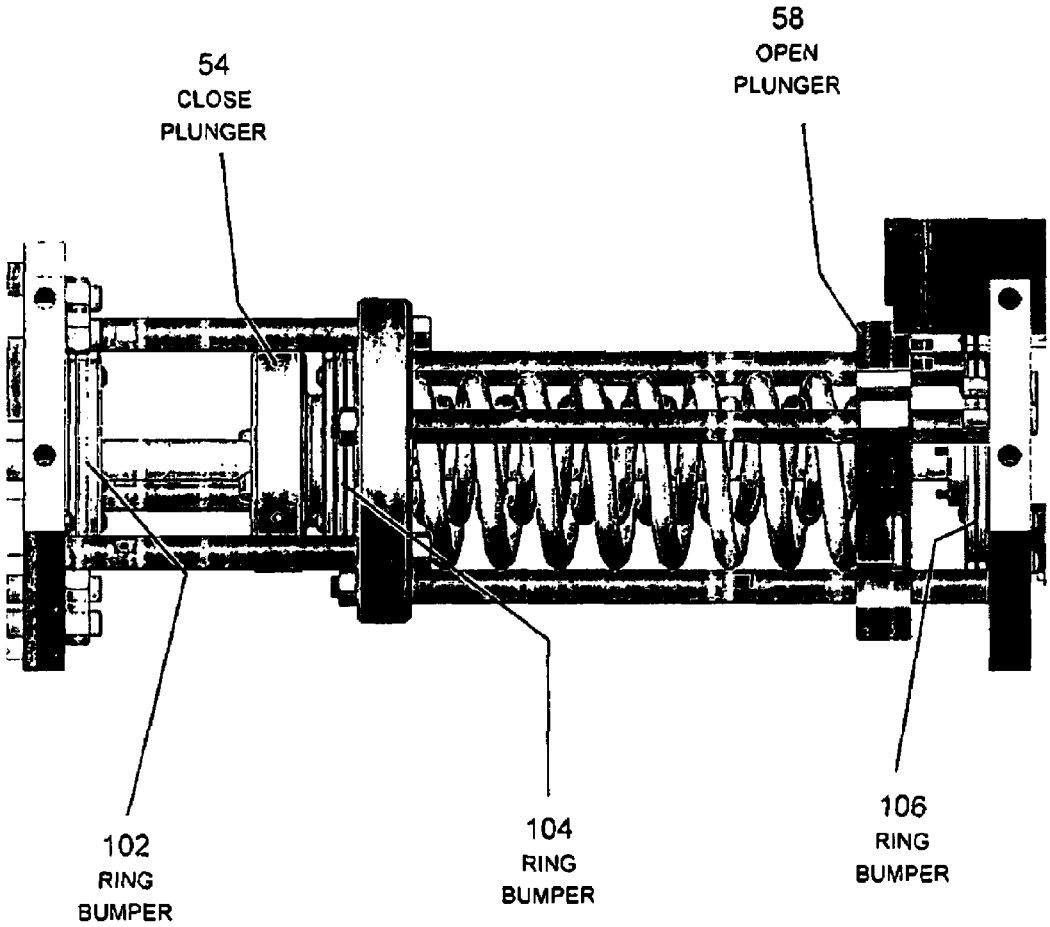
FIG. 13 is a front view of the open cage spring mechanism of the interrupter drive unit showing inline bumper rings.

FIG. 12 is a schematic view of a dual slot linkage feature of the bi-directional toggle mechanism 32 of the interrupter drive unit. One end of the open release rod 70 moves in the first slot link 66 and the other end is pivotally attached to the latch dog 100. One end of the latch dog 100 moves in the second slot link 76 and the other end is pivotally attached to open release rod 70. This dual slot link arrangement facilitates movement for the open latch 38 to relieve stress and prevent binding as the toggle mechanism operates the open latch. FIG. 13 is a front view of the open cage spring mechanism of the interrupter control unit showing in-line bumper rings 102, 104 and 106. The bumper rings cushion the open and close plungers, reducing stress and vibration in the drive unit.

The electric power switch 8 may be implemented as a standard unit that can be employed, with minor modification to adapt to the selected operating voltage, at different standard system voltages, such as 15.5 kV, 25.8 kV, 38 kV, 48.3 kV and 72.5 kV. The illustrative capacitor switch show substantially to scale in FIGS. 1 and 3 is specifically configured to operate at 38 kV. The electric power switch 8 may be implemented as a variety of standard units that can be employed at different standard system voltages, such as 15.5 kV, 25.8 kV, 38 kV, 48.3 kV and 72.5 kV. The illustrative capacitor switch is physically configured for 38 kV and show substantially to scale in FIGS. 1 and 3. This circuit interrupters 10*a-c* of this capacitor switch have a height of approximately 47 inches and a diameter of approximately 8 inches.

The interrupter control unit 20, or portions of the control unit, are shown substantially to scale in FIGS. 3-11. The interrupter control unit 20, which includes the interrupter drive unit 30 and the interrupter linkage 40, fits within an enclosure that is approximately 60 inches wide, 12 inches tall, and 10 inches deep. The physical size of the drive unit 30 may change, as appropriate, for switches configured to operate at different voltages. The illustrative 38 kV electric power switch may be manufactured with components having the following specifications: (a) the closing spring 56 may be 310 lbs. per inch spring rate; (b) the opening spring 60 may be 267 lbs per inch spring rate; (c) the return spring 84 may be 12 inch pounds per inch spring rate; (d) the motor 34 may be any suitable motor, such as a $1/5^{th}$ horsepower; ad (d) the solenoid 72 may be any suitable solenoid generating approximately 75 pounds of pull force. Most of the other components of the drive unit are fabricated to order from suitable steel stock. The roller abutment 90 are manufactured form The bumper rings 102, 104 and 106 may be manufactured from polyurethane with a thickness of about ⅛ inches each.

The skilled engineer will be readily able to implement design alternatives for the specific features of the preferred embodiments described above. In particular, the drive unit may be configured in different sizes with appropriate springs and other components to meet the contactor acceleration requirements for electric power switches operating at different voltages. Specific drive unit can therefore be designed for standard distribution, sub-transmission and transmission voltages operated by various electric utilities up to about 245 kV. As another design choice, the close latch may be tripped by a solenoid rather than a mechanical linkage driven by the charging cam, and both tripping devices may be replaced by other suitable design choices. The open and close springs could be arranged in a lateral series rather than a nested configuration. The drive unit could be operated manually or by an actuator other than an electric motor. The motor may be operated locally or remotely automatically or under supervisory control. Many other design choices may be altered within the teaching of the present invention. Nevertheless, it should also be appreciated that the specific design features shown in the figures and described above are considered appropriate to provide desirable cost, size, reliability and lifetime operation characteristics.

In view of the foregoing, it will be appreciated that present invention provides significant improvements in capacitor switches for electric power distribution and sub-transmission applications. It should be understood that the foregoing relates only to the exemplary embodiments of the present invention, and that numerous changes may be made therein without departing from the spirit and scope of the invention as defined by the following claims.

The invention claimed is:

1. An interrupter drive unit for an electric power switch configured for an alternating current electric power system operating at a system frequency, the electric power switch comprising a circuit interrupter including an electric contactor for introducing and removing an electric service component from an electric power circuit and an interrupter linkage configured for moving the electric contactor between a closed position in which the electric service component is electrically connected to the electric power circuit and an open position in which the electric service component is electrically removed from the electric power circuit, the interrupter drive unit comprising:

an opening spring operative for moving the interrupter linkage through an opening stroke to move the electric contactor from the closed position to the open position while preventing a current restrike at the system frequency;

an opening spring latch movable to a latched position for maintaining the opening spring in a charged configuration, and movable to a tripped position in response to an open trip action to release the opening spring to move the interrupter linkage through the opening stroke;

an opening stroke triggering device for imparting the open trip action to the opening spring latch;

a closing spring operative for moving the interrupter linkage through a closing stroke to move the electric contactor from the open position to the closed position while conducting a current arc during less than one-half of a current cycle at the system frequency;

a closing spring latch movable to a latched position for maintaining the closing spring in a charged configuration and releasing the closing spring in response to a close trip action to move the interrupter linkage through the closing stroke;

a closing stroke triggering device for imparting the close trip action to the closing spring latch;

a bi-directional toggle mechanism operative for moving the opening spring latch to its latched position, moving the opening spring to its charged configuration, moving the closing spring latch to its latched position, and moving the closing spring to its charged configuration; and wherein the opening spring latch, the closing spring latch and the toggle mechanism are positioned in a linear configuration with the bidirectional toggle mechanism located linearly between the opening spring latch and the closing spring latch.

2. The interrupter drive unit of claim 1, further comprising:

a charging cam operative to rotate through an operational cycle and, during the operational cycle, set the opening spring latch to maintain the opening spring to its charged position, move the opening spring to its charged position, set the closing spring latch to maintain the closing spring to its charged position, move the closing spring to its charged position, and trip the closing spring latch; and an electric motor operative to rotate the charging cam through its operational cycle.

3. The interrupter drive unit of claim 1, further configured to maintain the circuit interrupter in the closed configuration with the opening spring charged, ready to remove the electric service component from the electric power circuit, while the electric service component is electrically connected to the electric power circuit.

4. The interrupter drive unit of claim 3, further configured to maintain the circuit interrupter in the open position with the opening and closing springs discharged when the electric service component is electrically disconnected from the electric power circuit.

5. The interrupter drive unit of claim 1, wherein the system frequency is approximately fifty current cycles per second or approximately sixty current cycles per second.

6. The interrupter drive unit of claim 1, wherein the electric service component comprises a capacitor bank.

7. The interrupter drive unit of claim 1, wherein:

the opening stroke triggering device comprises an electric solenoid; and the closing stroke triggering device comprises a mechanical trigger actuated by the bi-directional toggle mechanism.

8. The interrupter drive unit of claim 1, wherein the opening spring and the closed spring are arranged in a coaxial nested arrangement.

9. The interrupter drive unit of claim 1, wherein the bidirectional toggle mechanism further comprises first and second slot links.

10. An electric power switch configured for an alternating current electric power system operating at a system frequency, comprising:

a circuit interrupter including an electric contactor for introducing and removing an electric service component from an electric power circuit;

an interrupter linkage configured for moving the electric contactor between a closed position in which the electric service component is electrically connected to the electric power circuit and an open position in which the electric service component is electrically removed from the electric power circuit; and an interrupter drive unit for causing the interrupter linkage to move the electric contactor between the closed and open positions, comprising:

an opening spring operative for moving the interrupter linkage through an opening stroke to move the electric contactor from the closed position to the open position while preventing a current restrike at the system frequency, an opening spring latch movable to a latched position for maintaining the opening spring in a charged configuration, and movable to a tripped position in response to an open trip action to release the opening spring to move the interrupter linkage through the opening stroke, an opening stroke triggering device for imparting the open trip action to the opening spring latch, a closing spring operative for moving the interrupter linkage through a closing stroke to move the electric contactor from the open position to the closed position while conducting a current arc during less than one-half of a current cycle at the system frequency, a closing spring latch movable to a latched position for maintaining the closing spring in a charged configuration and releasing the closing spring in response to a close trip action to move the interrupter linkage through the closing stroke, a closing stroke triggering device for imparting the close trip action to the closing spring latch, a bi-directional toggle mechanism operative for moving the opening spring latch to its latched position, moving the opening spring to its charged configuration, moving the closing spring latch to its latched position, and moving the closing spring to its charged configuration, and wherein the opening spring latch, the closing spring latch and the toggle mechanism are positioned in a linear configuration with the bidirectional toggle mechanism located linearly between the opening spring latch and the closing spring latch.

11. The electric power switch of claim 10, further comprising:

a charging cam operative to rotate through an operational cycle and, during the operational cycle, set the opening spring latch to maintain the opening spring to its charged position, move the opening spring to its charged position, set the closing spring latch to maintain the closing spring to its charged position, move the closing spring to its charged position, and trip the closing spring latch; and an electric motor operative to rotate the charging cam through its operational cycle.

12. The electric power switch of claim 10, further configured to maintain the circuit interrupter in the closed configuration with the opening spring charged, ready to remove the electric service component from the electric power circuit, while the electric service component is electrically connected to the electric power circuit.

13. The electric power switch of claim 12, further configured to maintain the circuit interrupter in the open position with the opening and closing springs discharged when the electric service component is electrically disconnected from the electric power circuit.

14. The electric power switch of claim 10, wherein the system frequency is approximately fifty current cycles per second or approximately sixty current cycles per second.

15. The electric power switch of claim 10, wherein the electric service component comprises a capacitor bank.

16. The electric power switch of claim 10, wherein:

the opening stroke triggering device comprises an electric solenoid; and the closing stroke triggering device comprises a mechanical trigger actuated by the bi-directional toggle mechanism.

17. The electric power switch of claim 10, wherein the opening spring and the closed spring are arranged in a coaxial nested arrangement.

18. The electric power switch of claim 10, wherein the toggle mechanism further comprises first and second slot links.

19. An electric power switch configured for an alternating current electric power system operating at a system frequency of approximately sixty cycles per second, comprising:

a capacitor bank;

a circuit interrupter including an electric contactor for introducing and removing the capacitor bank from an electric power circuit;

an interrupter linkage configured for moving the electric contactor between a closed position in which the capacitor bank is electrically connected to the electric power circuit and an open position in which the capacitor bank is electrically removed from the electric power circuit; and an interrupter drive unit for causing the interrupter linkage to move the electric contactor between the closed and open positions, comprising:

an opening spring operative for moving the interrupter linkage through an opening stroke to move the electric contactor from the closed position to the open position while preventing a current restrike at the system frequency, an opening spring latch movable to a latched position for maintaining the opening spring in a charged configuration, and movable to a tripped position in response to an open trip action to release the opening spring to move the interrupter linkage through the opening stroke, an opening stroke triggering device for imparting the open trip action to the opening spring latch, a closing spring operative for moving the interrupter linkage through a closing stroke to move the electric contactor from the open position to the closed position while conducting a current arc during less than one-half of a current cycle at the system frequency, a closing spring latch movable to a latched position for maintaining the closing spring in a charged configuration and releasing the closing spring in response to a close trip action to move the interrupter linkage through the closing stroke, a closing stroke triggering device for imparting the close trip action to the closing spring latch, a bi-directional toggle mechanism operative for moving the opening spring latch to its latched position, moving the opening spring to its charged configuration, moving the closing spring latch to its latched position, and moving the closing spring to its charged configuration, a charging cam operative to rotate through an operational cycle and, during the operational cycle, set the opening spring latch to maintain the opening spring to its charged position, move the opening spring to its charged position, set the closing spring latch to maintain the closing spring to its charged position, move the closing spring to its charged position, and trip the closing spring latch, an electric motor operative to rotate the charging cam through its operational cycle, and wherein the opening spring latch, the closing spring latch and the toggle mechanism are positioned in an linear configuration with the bidirectional toggle mechanism located linearly between the opening spring latch and the closing spring latch.

20. The electric power switch of claim 19, wherein:

the interrupter drive unit is configured to maintain the circuit interrupter in the closed configuration with the opening spring charged, ready to remove the capacitor bank component from the electric power circuit, while the electric service component is electrically connected to the electric power circuit; and the interrupter drive unit is further configured to maintain the circuit interrupter in the open position with the opening and closing springs discharged when the electric service component is electrically disconnected from the electric power circuit.

* * * * *